US006463012B1

(12) United States Patent
Bar-Yona

(10) Patent No.: US 6,463,012 B1
(45) Date of Patent: Oct. 8, 2002

(54) TIMEPIECES

(75) Inventor: Itzchak Bar-Yona, Rosh Ha'Ayin (IL)

(73) Assignee: M.V.T. Multi Vision Technologies Ltd., Rosh Ha'Ayin (IL)

( * ) Notice: Subject to any disclaimer, the term of this patent is extended or adjusted under 35 U.S.C. 154(b) by 0 days.

(21) Appl. No.: 09/448,146

(22) Filed: Nov. 24, 1999

Related U.S. Application Data

(63) Continuation-in-part of application No. 09/089,337, filed on Jun. 3, 1998, now Pat. No. 6,226,906.

(30) Foreign Application Priority Data

Apr. 15, 1999 (IL) ..... 129.455

(51) Int. Cl.[7] ..... G04B 19/04; G04B 25/00
(52) U.S. Cl. ..... 368/80; 368/223
(58) Field of Search ..... 368/79, 80, 223, 368/228, 232, 285

(56) References Cited

U.S. PATENT DOCUMENTS

| | | | | |
|---|---|---|---|---|
| 3,613,277 A | | 10/1971 | Rose et al. | |
| 3,660,919 A | | 5/1972 | Nagel | |
| 3,686,781 A | | 8/1972 | Calhoun, Jr. | |
| 4,034,555 A | * | 7/1977 | Rosenthal | 368/223 |
| 5,007,190 A | | 4/1991 | Shyu | |
| 5,276,987 A | | 1/1994 | Honse | |
| 5,426,879 A | | 6/1995 | Hecker | |
| 5,488,451 A | | 1/1996 | Goggins | |
| 5,494,445 A | | 2/1996 | Sekiguchi et al. | |
| 5,513,458 A | | 5/1996 | Dehli | |
| 5,586,089 A | * | 12/1996 | McGarvey | 368/223 |
| 5,724,758 A | | 3/1998 | Gulick, Jr. | |

FOREIGN PATENT DOCUMENTS

| | | |
|---|---|---|
| CH | 131144 | 1/1929 |
| CH | 321586 | 5/1957 |
| CH | 337793 | 4/1959 |
| EP | 0 622 653 | 11/1994 |
| JP | 2-211437 | 8/1990 |
| WO | WO 97/30436 | 8/1997 |

* cited by examiner

*Primary Examiner*—Vit Miska
(74) *Attorney, Agent, or Firm*—Oblon, Spivak, McClelland, Maier & Neustadt, P.C.

(57) ABSTRACT

The invention provides a self-powered timepiece including a housing; a lenticular panel mounted in the housing; a high-efficiency, battery-powered drive means having a cam; time-indicating means movable by the drive means, and a lightweight indicia carrier disposed inside the housing in close proximity to the panel, the carrier being displaceable by the cam in relation to the panel. The invention further provides a self-powered timepiece including a housing; a high-efficiency, battery-powered drive means; a lenticular panel coupled to the drive means; time-indicating means movable by the drive means, and a lightweight indicia carrier disposed inside the housing in close proximity to the panel, the panel being displaceable by the drive means in relation to the indicia carrier.

11 Claims, 5 Drawing Sheets

TIMEPIECES

FIELD OF THE INVENTION

The present invention relates to a timepiece such as a counter or wall clock, hand watch or the like, which displays movable images while indicating the time.

The present application is a continuation-in-part of U.S. patent application Ser. No. 09/089,337, filed Jun. 3, 1999 now U.S. Pat. No. 6,226,906.

BACKGROUND OF THE INVENTION

U.S. Pat. No. 5,008,869 describes a watch including a static visual display, such as a photograph, of the user's choice, inserted by the user himself. U.S. Pat. No. 5,380,206 discloses an animated character display for transforming a facial photograph into a personalized animated character. In comparison to the static visuals of U.S. Pat. Nos. 5,008,869, 5,380,206 incorporates a moving presentation of the image. U.S. Pat. No. 5,022,016 discloses a clock with an area for a display item, mainly for advertisement purposes.

More sophisticated prior art devices are illustrated in U.S. Pat. No. 5,455,808, which discloses an electronic timepiece having a mobile display with gradually changing images activated by a microprocessor, and in U.S. Pat. No. 5,566, 137, which describes a watch comprising an horological movement associated with a liquid crystal display (LCD) arrangement.

SUMMARY OF THE INVENTION

In contrast with the prior art versions of static image display, the present invention provides a multi-image timepiece capable of generating several animated images that can include photographs or graphic figures for advertising or decorative purposes. Also, contrary to the LCD display method, the present invention uses optical means and, as indicia carrier, a lithographic film which is easy to produce and is replaceable by the user. The actual indication of time can be integrated into the changing color and form of the graphic images; i.e., when an advertising logo is generated on the screen, the hands of the timepiece point to icons such as numbers or letters, which constantly change in color and form. High-efficiency drive mechanisms controlling the movement of the hands are also responsible to the graphic motion of the images, in such a way that all embodiments can be realized as self-sufficient products having their own source of energy.

It is therefore an object of the present invention to provide a timepiece displaying movable graphic images including photographs and different forms of artwork, together with the actual indication of the time.

It is also an object of the present invention to animate the time indication itself, using icons changing in color and form.

It is a further object of the present invention to provide a timepiece in which the indicia carrier, in the form of a lithographic film, may be easily replaced for advertising or decorative purposes.

A still further object of the present invention is to provide a stereoscopic presentation of moving images combined with an actual indication of the time.

In accordance with the present invention, there is thus provided a self-powered timepiece, comprising a housing; a lenticular panel mounted in said housing; a high-efficiency, battery-powered drive means having a cam; time-indicating means movable by said drive means, and a lightweight indicia carrier disposed inside said housing in close proximity to said panel, said carrier being displaceable by said cam in relation to said panel.

The invention further provides a self-powered timepiece, comprising a housing; a high-efficiency, battery-powered drive means; a lenticular panel coupled to said drive means; time-indicating means movable by said drive means, and a lightweight indicia carrier disposed inside said housing in close proximity to said panel, said panel being displaceable by said drive means in relation to said indicia carrier.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

Figure 1A:
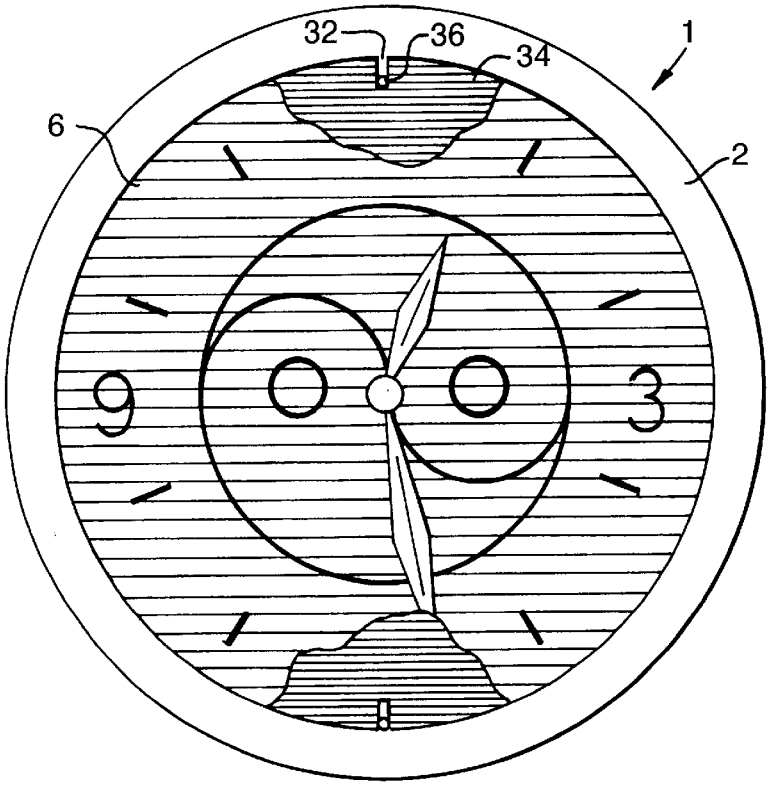
Figure 1B:
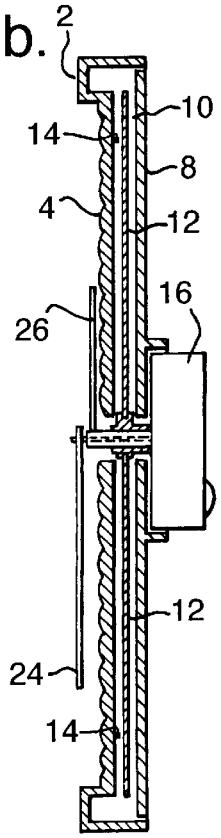
Figure 1C:
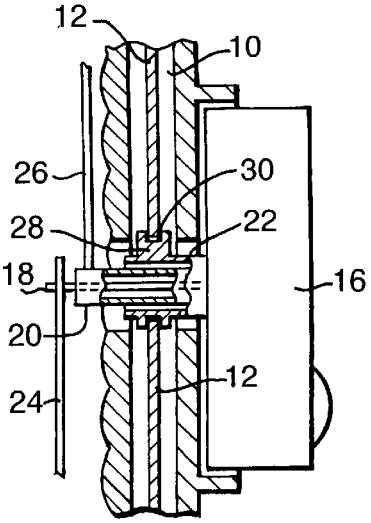

FIGS. 1*a* and 1*b* are front and cross-sectional views, respectively, of a timepiece according to the present invention;

FIG. 1*c* is an enlarged portion of the side view of FIG. 1*b;*

Figure 1D:
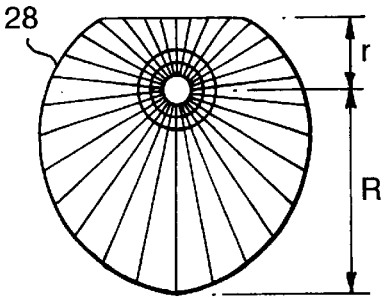

FIG. 1*d* is an enlarged front view of the eccentric shown in FIG. *b;*

Figure 1E:
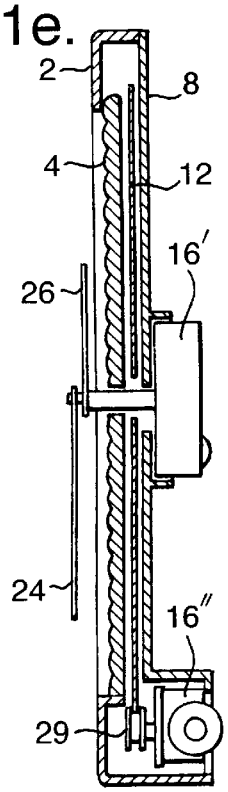

FIG. 1*e* is a modification of the embodiment of FIG. 1*b*.

Figure 2A:
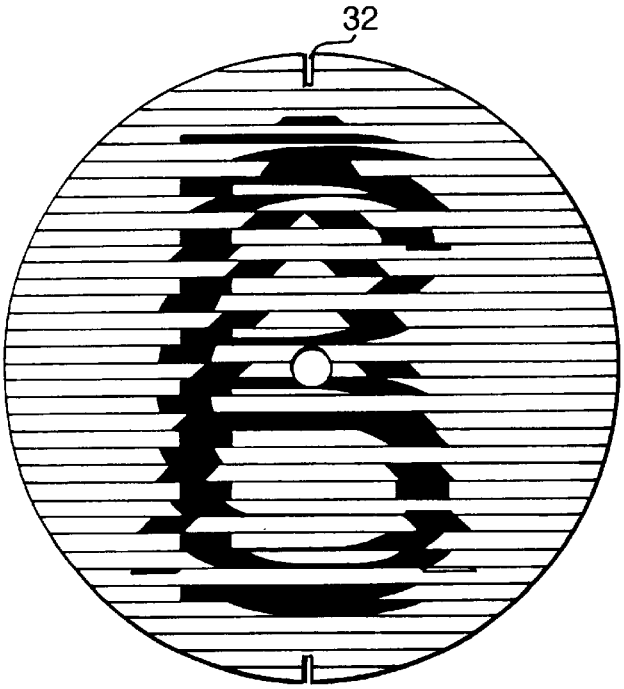
Figure 2B:
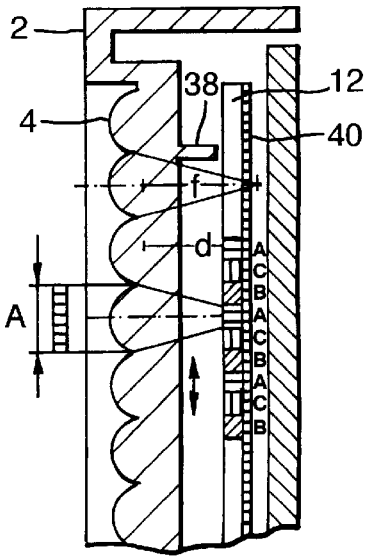
Figure 3A:
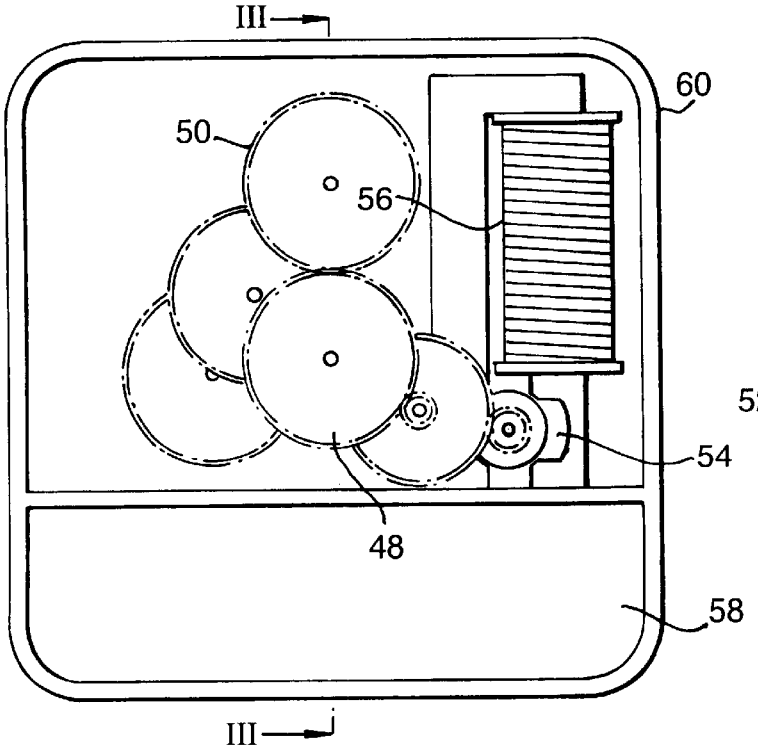
Figure 3B:
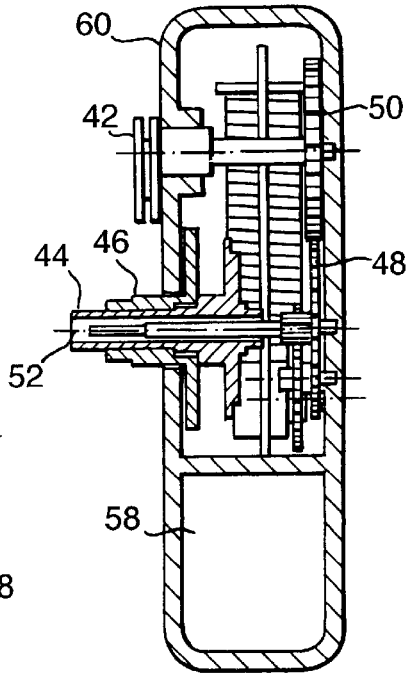
Figure 4A:
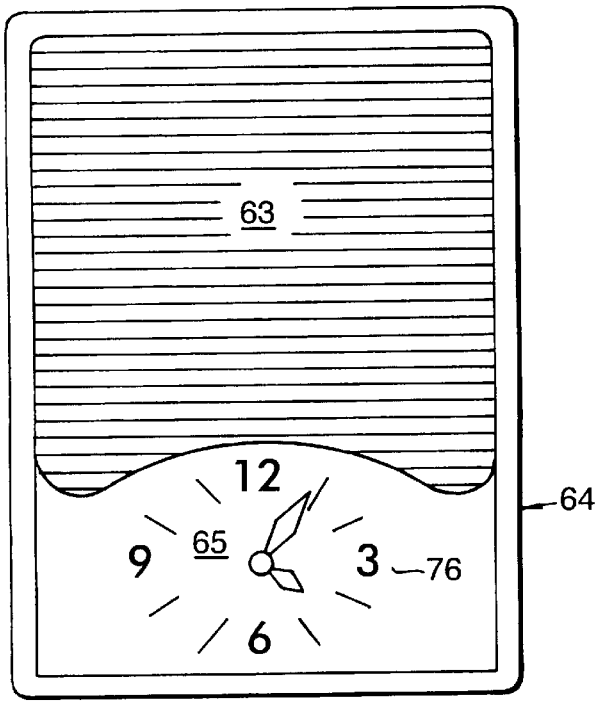
Figure 4B:
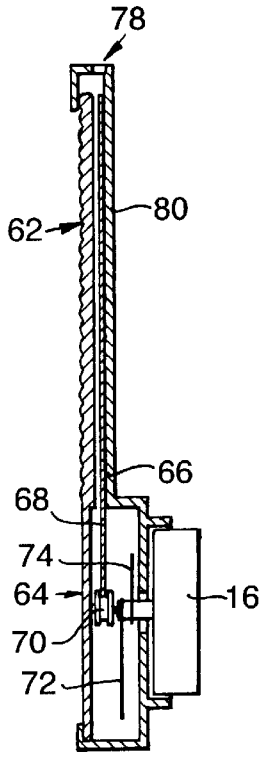
Figure 5A:
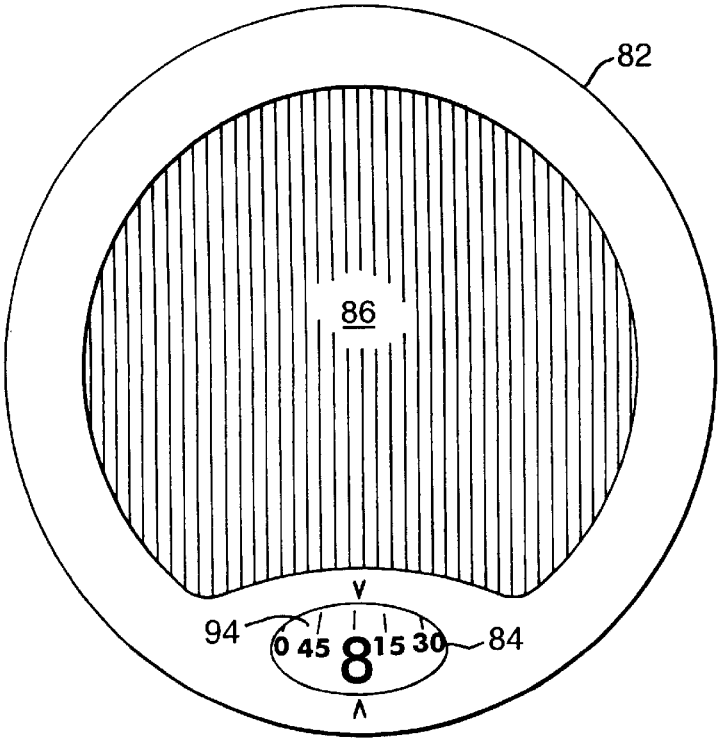
Figure 5B:
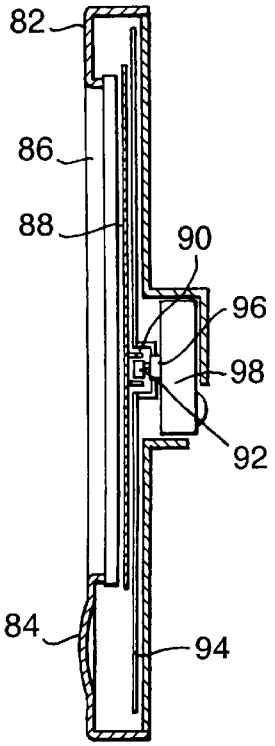
Figure 6A:
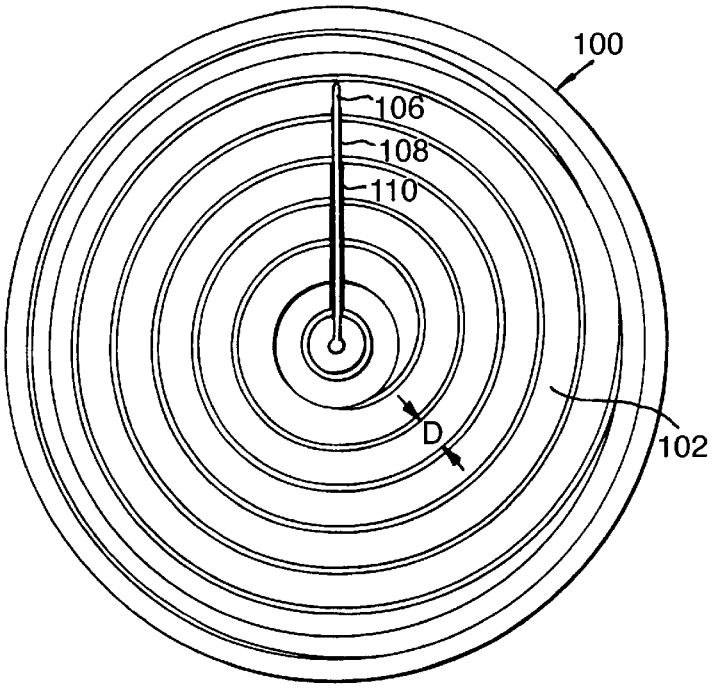
Figure 6B:
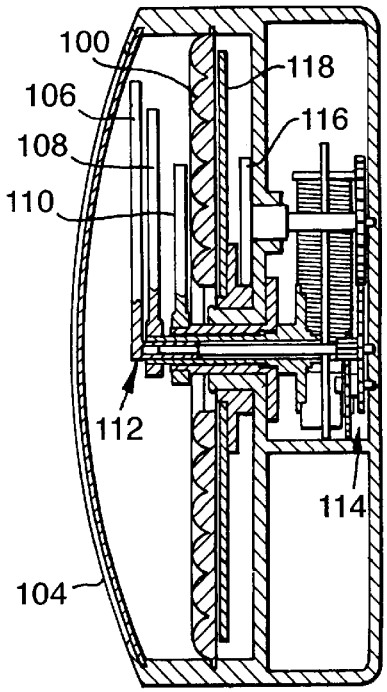
Figure 7:
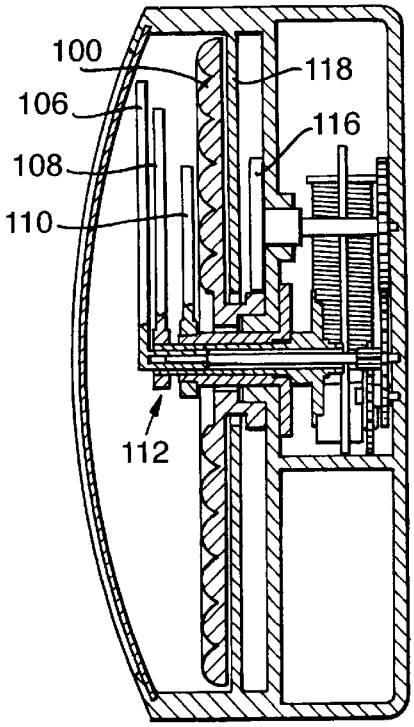
Figure 8:
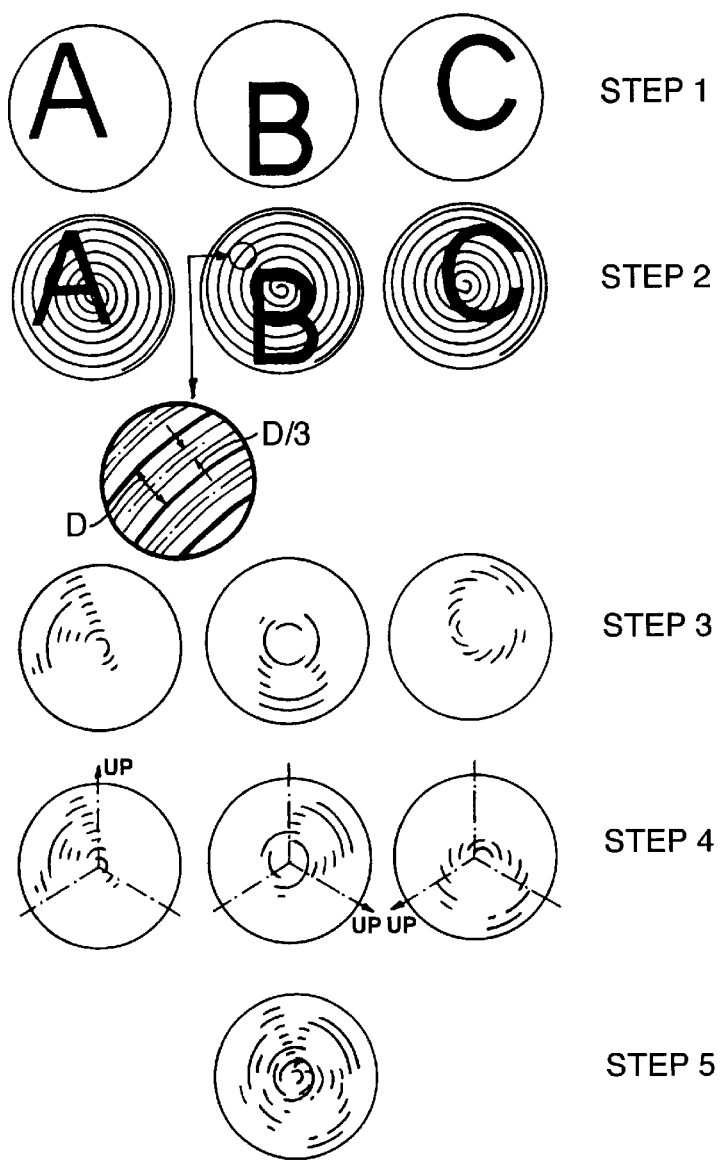
Figure 9:
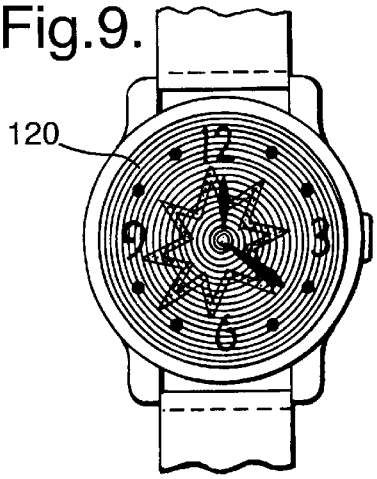
Figure 10:
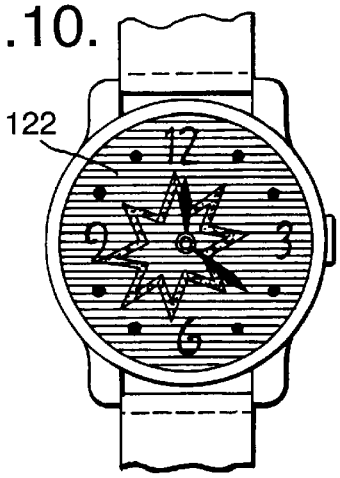

FIG. 2*a* is a view of an indicia carrier;

FIG. 2*b* illustrates the optical principles of the invention;

FIGS. 3*a* and 3*b* are front and cross-sectional views, respectively, of another embodiment of the present invention;

FIGS. 4*a* and 4*b* are front and cross-sectional views, respectively, of a further embodiment of the invention;

FIGS. 5*a* and 5*b* are front and cross-sectional views, respectively, of yet another embodiment of a timepiece according to the present invention;

FIGS. 6*a* and 6*b* are front and cross-sectional views, respectively, of a still further embodiment of the present invention;

FIG. 7 is a cross-sectional view of an embodiment similar to the embodiment of FIG. 6, in which the panel is rotatable with respect to the indicia carrier;

FIG. 8 illustrates a method of preparing a spiral lithographic indicia carrier for the embodiment of FIG. 6, and FIGS. 9 and 10 are front views of spiral and linear lenticular panels, respectively, for hand watches according to the present invention.

DETAILED DESCRIPTION OF PREFERRED EMBODIMENTS

FIGS. 1*a,* 1*b,* 1*c* and 1*d* illustrate the details of a first embodiment of a timepiece in the form of a wall clock according to the present invention. Seen is a frame 2 supporting a lenticular transparent panel 4 composed of cylindrical linear lenses 6 having a width substantially equal to the focal length of the lenses. A rigid planar board 8 is disposed spaced apart from said lenticular panel 4 at a distance of about one mm, forming a clearance 10 for accommodating an indicia carrier in the form of a lightweight film 12. Small ribs 14 project from the rear face of the lenticular panel 4 and retain film 12 at a constant distance from the lenses. Electro-mechanical drive 16 is attached to the rear face of board 8. Drive 16 has three concentric shafts: a central shaft 18, rotating at a speed of 1 rpm; an intermediate shaft 20 rotating at a speed of 1/60 rpm; and an external shaft 22 rotating at a speed higher than 60 rpm. The minute hand 24 of the clock is affixed to central shaft 18, the hour hand 26 is affixed to intermediate shaft 20, and film 12 is coupled to an eccentric portion 28 of external shaft 22.

FIG. 1*d* illustrates the geometric shape of portion 28 of the eccentric shaft. Its minimal radius r increases at a constant rate to the maximum radius R, and then constantly diminishes to minimal radius r. Portion 28 of shaft 22 is configured as an annular channel 30 for freely supporting the film therein. Thus, the uniform rotational movement of shaft 22 is transformed into linear uniform movement of the film 12 in a vertical direction.

FIG. 1*a* further shows the clock 1 wherein the lenticular screen has been partially removed to show two linear cutouts 32 made in diametrically opposite locations at the top and bottom of film 12, so as to extend perpendicular to the linear strips 34 of the lithographic printing on the film. Two pins 36 projecting from board 8 serve as guides for effecting the smooth linear displacement of the film 12.

FIGS. 2*a* and 2*b* schematically illustrate the optical method used in clock 1. The lithographic printing of 3 basic images A, B, C can be prepared by any method, as described in co-pending Israel Patent Applications Nos. 121,005 and 125,210 and in U.S. Pat. Nos. 5,100,330 and 5,488,451. Shown is lenticular screen 4 having small ribs 38 projecting from its rear side, spacing apart a lithographic film 12 at a distance d, which is determined by the focal length f of the lenses and the number of distinct images to be displayed on the screen, such that $d=f(1-1/n)$.

In the embodiment of FIGS. 2*a* and 2*b*, the three basic images are represented by the stripes A, B, C in a repetitive rhythm. A magnified strip A is displayed when compressed information belonging to lithographic print 40 is aligned with the axis of the screen lenses. A vertical displacement of the film 12 alternatively displays all three images. The ribs 38 of the lenticular screen fulfill the very important role of avoiding the electrostatic attachment of film 12 to the panel 4. As the whole dynamic system is based on the low-rate torque of the drive 16 and the gravitational force applied by film 12, considerations such as low friction alignment and guidance of the film are important.

FIGS. 3*a* and 3*b* respectively illustrate front and cross-sectional views of an embodiment of a drive mechanism wherein the eccentric shaft 42 is separated from the minute shaft 44 and hour shaft 46. Gear wheels 48, 50 associated with the second hand shaft 52 and eccentric 42 are both connected to a mini-rotor 54 driven by electromagnetic pulses generated by the coil 56. Battery compartment 58 is also provided inside the housing 60. The drive mechanism of this embodiment has the advantage that it includes a second hand, which was not included in the embodiment of FIG. 1.

Radio-controlled driving mechanisms (RC movements) are also known in the field. Such a movement is based on two different coils and motors, and can be used instead of the movement described above, providing the advantage of controlling the speed of eccentric 42.

FIGS. 4*a* and 4*b* disclose another embodiment of the clock. FIG. 4*a* is a front view of a movable image display area 62 having linear lenticular lens 63 separated from the time-indication area 64 behind a transparent cover 65, which may be made integrally with the lenticular display area 62. Such an embodiment is mostly suitable for images requiring no interference of the clock's hands. The lithographic film 66 includes a transparent area 68 freely supported by the eccentric shaft 70. The clock's hands 72, 74 and time-indicating numbers 76 are sheen through the transparent area 68. This embodiment offers an important advantage for the advertising market: the film 66 may be replaced at the user's choice by just dropping a new film 66 into a slot 78 located in the upper part of the clock's frame 80.

It is understood that the housing of the timepiece may be provided with an openable aperture, as opposed to the opening 78, facilitating the replacement by the user of the film or any other indicia carrer.

In the embodiment of FIGS. 5*a* and 5*b*, the time indication is made without the traditional clock hands. This embodiment also demonstrates the stereoscopic capability to present three-dimensional moving images. The clock comprises a rigid frame 82 having a transparent part 84 in its lower portion. Lenticular panel 86 has a vertical orientation. This embodiment also includes a small bracket 90 coupled to an eccentric 92 for displacing the film 88 in a horizontal direction. Guide means, similar to those of FIG. 1, are not shown. There is also provided a time indication scale 94, constituted by a rigid, lightweight disk bearing indicating icons printed on its circumference. Scale 94 is attached to the hour shaft 96 of the drive movement 98; second and minute shafts are omitted in this embodiment.

FIGS. 6*a* and 6*b* are front and cross-sectional views of a timepiece having a spiral lenticular panel 100. Such an embodiment can be used in wall clocks or hand watches, and presents rotational moving images. There is shown lenticular panel 100, designed as a continuous spiral lens 102 having a constant width D. A transparent shield 104 protects the inner part of the timepiece. Second, minute and hour hands 106, 108, 110 are connected to three concentric shafts 112 coupled to a gearbox 114. A special wheel 116 connected to gearbox 114 rotates a disk 118, on which lithographic multi-image information is printed. When the disk 118 rotates relative to the lenticular spiral panel 100, all of the basic images will alternately be displayed.

It is possible to obtain the same result by rotating a thin, lightweight lenticular film while the indicia carrier is kept stationary, as seen in FIG. 7. Accordingly, the panel 100 is coupled to the outer one of the concentric shafts 112, while the lithographic multi-image information is printed on the stationary disk 118.

FIG. 8 depicts a method of preparing a spiral lithographic print, as follows:

| | |
|---|---|
| Step 1 | Basic images are prepared; in this particular case, the images comprise three digital computer files of the letters A, B, C. |
| Step 2 | The information of each file is contained in a spiral linear frame having an uniform width D. |
| Step 3 | The information contained in each spiral linear file is compressed to one-third of D. |

-continued

| | |
|---|---|
| Step 4 | The files are shifted angularly: the first file A does not change; the second file B is rotated 120°, and the third file C is rotated 240°. The rate of rotation shifting is equal to 360/M, where M is the number of files. |
| Step 5 | All three files are superimposed to form a compact, single file. |
| Step 6 | A simulation of the compressed lithographic film is monitored. |
| Step 7 (not shown) | The compressed lithographic film is printed. |

Hand watches, wall or counter clocks having a spiral lenticular panel 120 (FIG. 9) or a linear lenticular panel 122 (FIG. 10) may be provided under the same principles of construction and operation as those described above.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A self-powered timepiece, comprising:

a housing;

a lenticular panel mounted in said housing;

a high-efficiency, battery-powered drive means having a cam;

time-indicating means movable by said drive means, and a lightweight indicia carrier disposed inside said housing in close proximity to said panel, said carrier being displaceable by said cam in relation to said panel.

2. The timepiece as claimed in claim 1, wherein said lenticular panel comprises linear lenses extending in the vertical or horizontal direction.

3. The timepiece as claimed in claim 1, wherein said lenticular panel comprises a continuous spiral lens of a uniform width.

4. The timepiece as claimed in claim 1, wherein said drive means comprises at least two concentric shafts to which the hour and minute hands of a timepiece are coupled.

5. The timepiece as claimed in claim 4, further comprising a third concentric shaft to which said cam is coupled.

6. The timepiece as claimed in claim 1, further comprising guide means associated with said indicia carrier.

7. The timepiece as claimed in claim 1, wherein said time indication means is juxtaposed relative to said lenticular panel.

8. The timepiece as claimed in claim 1, wherein said lenticular panel comprises a further portion substantially contiguous with said panel, said further portion begin transparent for viewing said time indicating means.

9. The timepiece as claimed in claim 1, wherein at least a part of said time-indicating means constitutes at least a portion of said indicia carrier.

10. The timepiece as claimed in claim 1, wherein said time-indicating means comprises a disk bearing time-indicating indicia along its periphery.

11. The timepiece as claimed in claim 1, wherein said housing is provided with an opening or an openable aperture and said indicia carrier is replaceable through said opening or aperture.

* * * * *

UNITED STATES PATENT AND TRADEMARK OFFICE

CERTIFICATE OF CORRECTION

PATENT NO. : 6,463,012 B1
DATED : October 8, 2002
INVENTOR(S) : Bar-Yona

It is certified that error appears in the above-identified patent and that said Letters Patent is hereby corrected as shown below:

Title page,
Item [30], Foreign Application Priority Data, should read:

-- [30], Foreign Application Priority Data

Apr. 15, 1999 (IL)……..129,455
Jun. 5, 1997 (IL)……..121,005 --

Signed and Sealed this

Fifth Day of October, 2004

JON W. DUDAS
*Director of the United States Patent and Trademark Office*